US006966083B1

(12) United States Patent
Cheng

(10) Patent No.: US 6,966,083 B1
(45) Date of Patent: Nov. 22, 2005

(54) MAGNETIC LEVITATION BED

(76) Inventor: Shao-Szu Cheng, PO Box 82-144, Taipei (TW)

( * ) Notice: Subject to any disclaimer, the term of this patent is extended or adjusted under 35 U.S.C. 154(b) by 0 days.

(21) Appl. No.: 11/024,449

(22) Filed: Dec. 30, 2004

(51) Int. Cl.[7] ..... A61G 7/00
(52) U.S. Cl. ..... 5/108; 5/609; 310/90.5
(58) Field of Search ..... 5/108, 607, 608–610; 310/90.5; 472/59–31, 130; 601/90–92, 98

(56) References Cited

U.S. PATENT DOCUMENTS 3,570,023 A * 3/1971 Bennett ..... 5/109

* cited by examiner

*Primary Examiner*—Heather Shackelford
*Assistant Examiner*—Fredrick Conley
(74) *Attorney, Agent, or Firm*—Leong C. Lei

(57) ABSTRACT

A magnetic levitation bed is disclosed to include a bed frame, which is equipped with a plurality of permanent magnet arrays, a first cam-fitting mechanism, and a second cam-fitting mechanism, and a base, which is equipped with a power control box controllable by a remote controller, a plurality of electromagnet arrays arranged corresponding to the permanent magnet arrays and controllable by the control box to attract and repulse the permanent magnet arrays, a first low-speed motor controllable by the power control box to turn a first cam relative to the first cam-fitting mechanism and to further cause the bed frame to oscillate in transverse direction, a second low-speed motor controllable by the power control box to turn a second cam relative to the second cam-fitting mechanism and to further cause the bed frame to oscillate in longitudinal direction, and sensors for detecting oscillation of the bed frame and providing a signal indicative of the position change of the bed frame to a microprocessor for enabling the power control box to control the operation of the first low-speed motor or second low-speed motor subject to the data received from the sensors.

4 Claims, 2 Drawing Sheets

MAGNETIC LEVITATION BED

BACKGROUND OF THE INVENTION (a) Technical Field of the Invention

The present invention relates to a bed and more particularly to, a magnetic levitation bed, which enables the bed frame to be suspended on a magnetic cushion and oscillated transversely/longitudinally.

(b) Description of the Prior Art

Conventional massaging beds are commonly made in the form of a waterbed or aircushion bed in which links, gears, transmission belts, transmission chains are provided between the bed frame and the base and driven to move the bed frame relative to the base. A hydraulic mechanism may be used and controlled to oscillate the bed frame relative to the base. These conventional designs use motor to drive the transmission or hydraulic mechanism. During operation, the moving parts of the mechanism may injure the user or operator accidentally. Further, the driving motor consumes much electric energy and produces a big noise during operation. The motor may be burned out when overload or if the operator forgot to turn off power supply.

SUMMARY OF THE INVENTION

The primary purpose of the present invention is to provide a magnetic levitation bed, which is practical for the public, more particularly for an aged person, baby, disabled person, or any person in a persistent vegetative state. The magnetic levitation bed can be controlled to oscillate the bed frame transversely/longitudinally or to move the bed frame alternatively up and down, comforting the baby like a cradle.

Regular magnetic levitations include: permanent magnet repulsive levitation, permanent magnet and electromagnet magnetic levitation, permanent magnet attractive and repulsive levitation, super conducting attractive and repulsive levitation, and permanent magnet compensatory technique.

The magnetic levitation bed of the present invention has the magnets at the bed frame and the magnets at the base form "repulsive magnetic levitation mechanism" and "attractive magnetic levitation mechanism". Further, the permanent magnets at the bed frame and the electromagnets at the base provide a "magnetic compensatory and conductive technique". This design has the advantages of high magnetic levitation, low energy consumption, high machine reliability, high operation convenience, and low manufacturing cost.

The magnetic levitation bed enables the bed frame to be supported on a magnetic cushion. By means of a magnetic repulsive force, the bed frame is supported on a magnetic cushion above the base. Further, by means of changing the pole of the electromagnets, the bed frame is oscillated transversely/longitudinally. The invention eliminates the use of any linking or transmission mechanisms or motor drive. Because of zero coefficient of friction between the bed frame and the base, no any noise is produced during the operation of the magnetic levitation bed.

Because the invention eliminates the use of links, gears, belts, chains, or any of a variety of transmission mechanisms between the bed frame and the base. The invention also eliminates the use of a motor drive to move the bed frame relative to the base. By means of magnetic repulsive and attractive force, the bed frame is moved relative to the base smoothly without noise. Therefore, the magnetic levitation bed is safe in use. The magnetic levitation bed can also help promote the circulation of blood of the person lying on the bed frame.

Because the invention uses magnetic repulsive and attractive force to move the bed frame relative to the base instead of the use of complicated motor drive and mechanical transmission mechanism in the conventional design, the magnetic levitation bed is much cheaper than the conventional design. Further, the magnetic levitation bed consumes only a small amount of electric energy to keep the bed frame suspended on the magnetic cushion above the base. The innovative, functional, high-performance design of the magnetic levitation bed provides a combination of functions for physical therapy, body exercising, resting, and sleeping.

In general, the magnetic levitation bed of the present invention has the following features:

1. High safety: because the bed frame has no power circuit or electric device installed therein, the bottom rubber pads fall with the bed frame onto the uprights of the base upon stoppage of the operation of the electromagnets at the base. The rubber pads support the bed frame steadily on the uprights of the base, and provide a good insulative effect. The magnetic levitation bed consumes low voltage power supply to drive the electromagnets (110~240V). Because the invention does not require high voltage or big current, no high voltage radiation exists during the operation of the magnetic levitation bed. Because the invention eliminates the uses magnetic repulsive and attractive force to move the bed frame relative to the base instead of the use of complicated motor drive and mechanical transmission mechanism in the conventional design, the magnetic levitation bed is safe in use. Further, a shield prepared from industrial pure iron or the like is provided to shield magnetic waves, lowering the magnetic field of the bed frame to below 10 gauss.

2. Low power consumption: the magnetic levitation bed consumes about 0.1 kw/hour when supporting a load of about 200 kgs. Therefore, the operation of the magnetic levitation bed does not produce heat energy, eliminating the change of occurrence of fire.

3. Easy maintenance: because no linking mechanism is provided between the bed frame and the base, the bed frame does not touch the base during its motion. Because no friction resistance is produced between the bed frame and the base, the magnetic levitation bed is durable and reliable. Maintenance work is mainly at electronic techniques without much labor.

4. Zero pollution: the magnetic levitation bed does not produce noise or harmful gas during operation; therefore, the invention does not cause any environmental pollution.

5. Magnetic induced power supply system: during operation of the magnetic levitation bed, the bed frame is suspended on the magnetic cushion above the base without contact. In case illuminator or bed stereo is used, coil induction type wireless power supply technique can be employed to provide the necessary working voltage from the base to the electric devices in the bed frame.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1~4, a magnetic levitation bed in accordance with the present invention is comprised of a bed frame 1 and a base 2.

Figure 1:
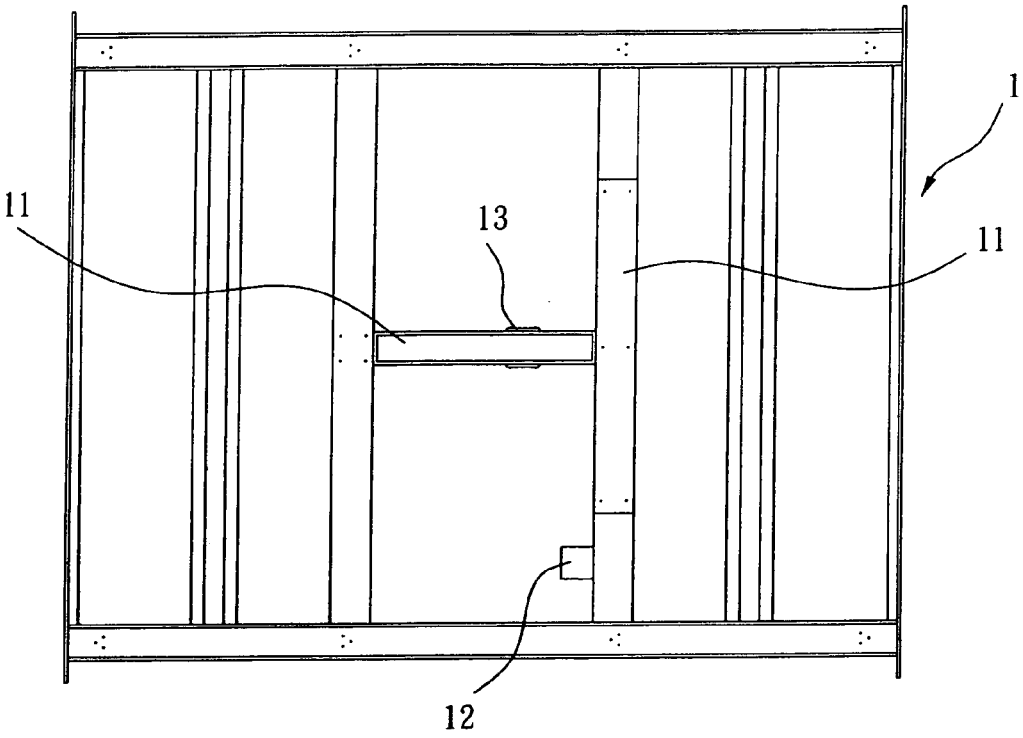
FIG. 1 is a top plain view of a bed frame for magnetic levitation bed according to the present invention.
Figure 2:
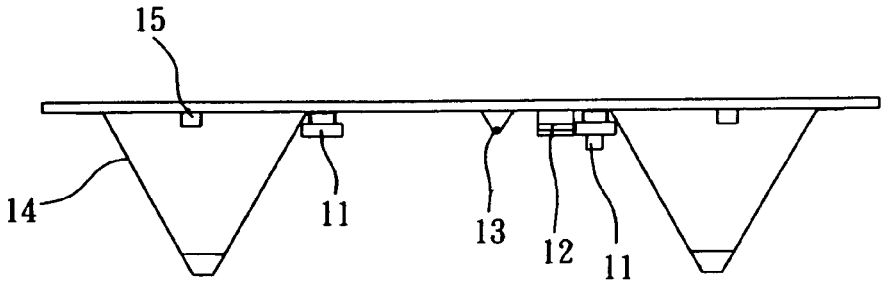
FIG. 2 is a front view of the bed frame for magnetic levitation bed according to the present invention.

Referring to FIGS. 1 and 2, the bed frame 1 is a framework of tough material. If desired, the bed frame 1 can be attached with a headboard, sideboards, a footboard, a stereo system, a remote controller, and a mattress. The bed frame 1 has a plurality of foot members 14 downwardly extending from the bottom wall, a plurality of rubber pads 15 provided at the bottom wall, a plurality of permanent magnet arrays 11 arranged at suitable locations at the bottom wall, a first cam-fitting mechanism 12 provided at the bottom wall near one lateral side, and a second cam-fitting mechanism 13 provided at the bottom wall on the middle.

Figure 3:
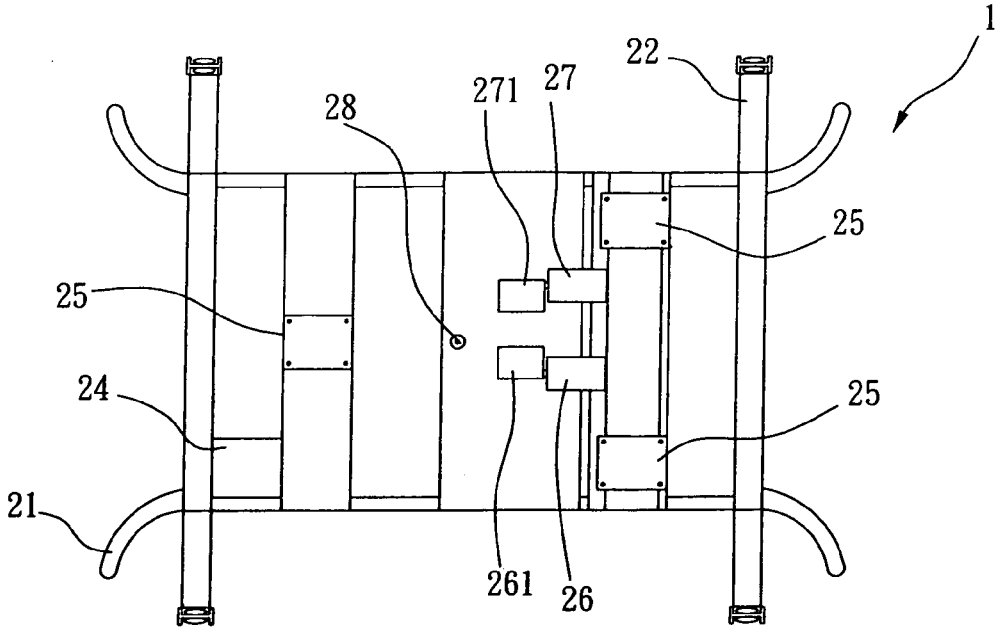
FIG. 3 is a top view of a base for magnetic levitation bed according to the present invention.
Figure 4:
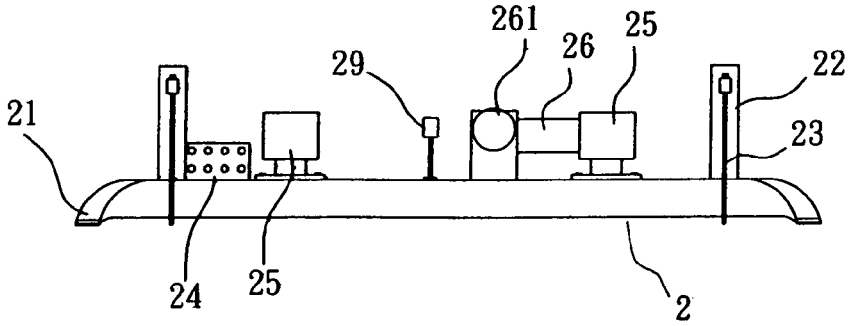
FIG. 4 is a front view of the base for magnetic levitation bed according to the present invention.

Referring to FIGS. 3 and 4, a base 2 comprises a bottom frame 21, a plurality of uprights 22, a plurality of safety suspension arms 23 respectively installed in the uprights 22, a power control box 24 mounted on the bottom frame 21 at a suitable location, a plurality of electromagnet arrays 25 arranged on the base frame 21 corresponding to the permanent magnet arrays 11 at the bed frame 1, a first low-speed motor 26 and a second low-speed motor 27 mounted on the base frame 21, a first cam 261 coupled to the first low-speed motor 26 corresponding to the first cam-fitting mechanism 12 at the bed frame 1, and a second cam 271 coupled to the second low-speed motor 27 corresponding to the second cam-fitting mechanism 13 at the bed frame 1. The bed frame 1 is installed in the base 2, keeping the rubber pads 15 respectively supported on the uprights 22. After installation of the bed frame 1 in the base 2, the first cam 261 is kept in close contact with the first cam-fitting mechanism 12, the second cam 271 is kept in close contact with the second cam-fitting mechanism 13, and the permanent magnet arrays 11 are respectively laid on the electromagnet arrays 25. Further, an upwardly facing sensor (electric eye) 28 and a downwardly facing sensor (electric eye) 29 are provided at the base 2. A remote-control receiver is also installed in the base 2 for receiving control signal from a remote controller.

The operation of the present invention is outlined hereinafter. Upon receipt of the start signal from the remote controller, the remote-control receiver immediately drives the power control box 24 to start the electromagnet arrays 25, thereby producing a magnetic repulsive force between the electromagnet arrays 25 and the permanent magnet arrays 11. The magnetic repulsive force forms a magnetic cushion, and the bed frame 1 is suspended on the magnetic cushion above the uprights 22 of the base 2.

Upon receipt of the transverse oscillation signal from the remote controller, the remote-control receiver immediately drives the power control box 24 to start the first low-speed motor 26, causing the first cam 261 to rotate relative to the first cam-fitting mechanism 12, and therefore the bed frame 1 is tilted rightwards. At this time, the upwardly facing sensor (electric eye) 28 and the downwardly facing sensor (electric eye) 29 detect position change of the bed frame 1 and provide a corresponding signal to the microprocessor in the transverse oscillation signal. Upon receipt of the signal, the microprocessor drives the remote-control receiver drives the power control box 24 to change the magnetic pole of the electromagnet arrays 25, thereby causing the bed frame 1 to be tilted leftwards. These rightward tilting and leftward tilting actions are alternatively performed, and therefore the bed frame 1 is continuously oscillating leftwards and rightwards within a limited angle.

Upon receipt of the longitudinal oscillation signal from the remote controller, the remote-control receiver immediately drives the power control box 24 to start the second low-speed motor 27, causing the second cam 271 to rotate relative to the second cam-fitting mechanism 13, and therefore the bed frame 1 is tilted forwards. At this time, the upwardly facing sensor (electric eye) 28 and the downwardly facing sensor (electric eye) 29 detect position change of the bed frame 1 and provide a corresponding signal to the microprocessor in the transverse oscillation signal. Upon receipt of the signal, the microprocessor drives the remote-control receiver drives the power control box 24 to change the magnetic pole of the electromagnet arrays 25, thereby causing the bed frame 1 to be tilted backwards. These forward tilting and backward tilting actions are alternatively performed, and therefore the bed frame 1 is continuously oscillating forwards and backwards within a limited angle.

Upon receipt of the vertical vibration signal from the remote controller, the remote-control receiver immediately drives the microprocessor to alternatively change the magnetic pole of the electromagnet arrays 25, thereby causing a magnetic repulsive force and a magnetic attractive force to be alternatively produced between the electromagnet arrays 25 and the permanent magnet arrays 11, and therefore the bed frame 1 is alternatively moved up and down.

Upon receipt of the stop signal from the remote controller, the remote-control receiver immediately drives the power control box 24 to cut off power supply from the electromagnet arrays 25, and therefore the bed frame 1 immediately falls to the uprights 22 of the base 2.

Further, during transverse or longitudinal oscillation of the bed frame 1 relative to the base 2, the safety suspension arms 23 limit the angle of oscillation of the bed frame 1 to a safety range. Further, a shielding structure (not shown) is provided to shield magnetic waves from the electromagnet arrays 25 and the permanent magnet arrays 11.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A magnetic levitation bed comprising;

a bed frame, said bed frame comprising a plurality of permanent magnet arrays arranged at a bottom side thereof, a first cam-fitting mechanism, and a second cam-fitting mechanism; and a base adapted to support said bed frame, said base comprising a power control box, a plurality of electromagnet arrays arranged corresponding to said permanent magnet arrays at said bed frame and controllable by said control box to attract and repulse said permanent magnet arrays, a first low-speed motor controllable by said power control box, a first cam coupled to said first low-speed motor corresponding to said first cam-fitting mechanism for acting against said first cam-fitting mechanism to oscillate said bed frame in transverse direction upon rotation of said first low-speed motor, a second low-speed motor controllable by said power control box, a second cam coupled to said second low-speed motor corresponding to said second cam-fitting mechanism for acting against said second cam-fitting mechanism to oscillate said bed frame in longitudinal direction upon rotation of said second low-speed motor, a remote-control receiver controllable by a remote controller for controlling the operation of said power control box, and sensor means adapted to detect oscillation of said bed frame and to provide a signal indicative of the position change of said bed frame to a microprocessor in said remote-control receiver for enabling said remote-control receiver to control the operation of said power control box subject to the data received from said sensor means.

2. The magnetic levitation bed as claimed in claim 1, wherein said base comprises a base frame and a plurality of upright rights upwardly extending from said base frame for supporting said bed frame; said bed frame comprises a plurality of bottom rubber pads corresponding to said uprights.

3. The magnetic levitation bed as claimed in claim 1, wherein said base comprises a plurality of safety suspension arms adapted to limit the angle of oscillation of said bed frame in transverse direction and longitudinal direction.

4. The magnetic levitation bed as claimed in claim 1, further comprising shielding means that shields magnetic waves from said electromagnet arrays and said permanent magnet arrays.

* * * * *